United States Patent [19]

Conklin et al.

[11] 4,074,246

[45] Feb. 14, 1978

[54] CONTACT SYSTEM FOR SENSING CLOSURES

[75] Inventors: Robert M. Conklin, Chappaqua, N.Y.; Charles J. Everett, Clinton; Arthur T. Human, Norwalk, both of Conn.

[73] Assignee: Holmes Protection, Inc., New York, N.Y.

[21] Appl. No.: 658,445

[22] Filed: Feb. 17, 1976

[51] Int. Cl.[2] ..... G08B 13/08

[52] U.S. Cl. ..... 340/274 R; 340/258 C; 340/275; 340/416

[58] Field of Search ..... 340/276, 275, 274 R, 340/258 C, 280, 416

[56] References Cited

U.S. PATENT DOCUMENTS

| | | | |
|---|---|---|---|
| 3,514,627 | 3/1970 | Bridgeman | 340/275 X |
| 3,924,257 | 12/1975 | Roberts | 340/275 X |
| 3,932,858 | 1/1976 | Smith et al. | 340/280 |

*Primary Examiner*—Glen R. Swann, III
*Attorney, Agent, or Firm*—Wolder & Gross

[57] ABSTRACT

A system for sensing the open or closed position of a closure member such as a window or door includes a first winding having a magnetic core and an audio frequency electromechanical first transducer and electrically interconnected and mounted on the closure member. A second winding having a magnetic core and an audio frequency mechanical electrical second transducer are mounted on a stationary base and the cores are closely coupled as are the transducers when the closure member is in closed position. The second winding is connected to a pulsed ultrasonic alternating current, and the second transducer is connected by way of amplifiers to a multiplex signal transmitting network. The opening of the closure member uncouples the cores and the transducers to produce a signal change at the transmitting network output. In an alternative structure an infrared LED and an infrared phototransistor are stationary, and closure member mounted mirrors light couple the LED and phototransistor when the closure member is in closed position, and uncouple them when in open position. The system can be remotely tested for equipment malfunction or attempts to compromise the equipment. The system can be coded so that each set of contacts can respond within a different time slot, and substitution of an unauthorized unit or set of contacts can be immediately detected.

15 Claims, 9 Drawing Figures

Fig. 1a.

CONTACT SYSTEM FOR SENSING CLOSURES

BACKGROUND OF THE INVENTION

The present invention relates generally to improvements in position sensing devices and it relates more particularly to an improved system for sensing the closed position of a door, window or other closure member.

In burglar alarm systems it is a common practice to provide switches at windows and doors in a manner that the switch is transferred between its open and close state with the opening and closing of the door and the state of the switch controls an alarm or the transmission of an information signal to a remote monitoring point. The switches are generally mechanical in nature and usually include a pair of switch contacts which are shorted by a conductor strip carried by the window or door and when in closed position. The use of mechanical switches in sensing the position of a closure member possesses numerous drawbacks and disadvantages. They are easily by-passed and tampered with to provide a closure member closed response even when such closure member is in a fully open position, they are unreliable and easily disabled devices, are of limited versatility and adaptability and otherwise leave much to be desired. The use of permanent magnet actuated switches have been employed but this has not remedied the deficiencies and drawbacks of the mechanically operated switches.

SUMMARY OF THE INVENTION

It is accordingly a principal object of the present invention to provide an improved position sensing device.

Another object of the present invention is to provide an improved sensing system responsive to the open and closed positions of a door, window or other like closure members.

Still another object of the present invention is to provide a burglar alarm or warning system in which the open and closed positions of a closure member are sensed by non-mechanical means.

A further object of the present invention is to provide in a burglar alarm or warning system a non-mechanical closure position sensing system which cannot be bypassed or disabled by unauthorized persons.

Yet a further object of the present invention is to provide for remote testing of the system to ascertain if the equipment is functioning properly, or if an attempt is being made to tamper or compromise the system.

Yet a further object of the present invention is to provide a system with a plurality of contacts which respond to an initial test signal at different predetermined times which prevents the use of a set of contacts other than in its predetermined locations.

Still yet a further object of the present invention is to provide a system of the character described in which coding means are provided to deter substitution of one of a set of contacts by an unauthorized party.

Still a further object of the present invention is to provide a system of the above nature characterized by its high reliability, fool proof and tamper proof character, ease of installation and great versatility and adaptability.

The above and other objects of the present invention will become apparent from a reading of the following description taken in conjunction with the accompanying drawings which illustrate preferred embodiments thereof.

In a sense the present invention contemplates the provision, in combination with a closure member movable between an open and closed position relative to a stationary member, of an improved system for sensing the position of the closure member relative to the stationary member comprising a first transducer having an electrical input and an output signal of a predetermined type, for example, an audio signal from the subsonic to supersonic range, a light or other electromagnetic radiation, a varying magnetic field and the like, the first transducer being located on one of the members, a second transducer having an input signal of said predetermined type and an electrical output, the first and second transducers being tightly coupled by way of the predetermined signal type when the closure member is in closed position and being relatively uncoupled when the closure member is in open position, and means responsive to the second transducer output signal.

In accordance with a preferred embodiment of the present invention as applied to a door or window type closure member, the first transducer is mounted on the closure member and is an electromechanical audio transducer which may be electromagnetic, piezoelectric, or the like and the second transducer is mechanically electric and may be the same as the first transducer and is mounted on the stationary member with the output face of the first transducer closely confronting the input face of the second transducer when the closure member is closed. A first winding is located on the stationary member and includes a first magnetic core and a second winding is located on the closure member and includes a second magnetic core which is closely magnetically coupled to the first core when the closure member is in closed condition. The first and second windings are finely tuned by capacitors to resonate at the same supersonic frequency which is the peak response frequency of the transducers, the first winding being connected to a pulsed AC source at such frequency and the seond coil being connected to the input of the first transducer. The electrical output of the second transducer is connected to an amplifier and timing network whose output is multiplex signal which controls or transmits a warning signal or alarm. The timing network allows for remote monitoring of the complete system by sequential responses from each set of windows to a single test pulse. Furthermore coding discs may be used to deter unauthorized substitution or one of a set of contacts.

When employed on a window, door panel or the like, the second coil is connected to the first transducer by way of a frangible conductor circuit located along the border of the window pane.

In accordance with another form of the present system, the first transducer is an infrared LED and the second transducer is an infrared responsive photosensitive element. The closure member carries a pair of mirrors which, when the closure member is in closed position, directs the light emitted by the LED to the photosensitive element which is connected to the input of an amplifier and alarm or warning signal generator.

The improved system obviates the need, in a closure member position sensing system, of any mechanical switches and overcomes the numerous drawbacks accompanying the use to such switches and is highly reliable, substantially tamperproof, easy to install and of great versatility and adaptability. Moreover, the operability of the improved system may be easily and rapidly remotely determined such as from the remote monitoring station by merely interrupting the electric signal transmitted from the energizing station to the transducers of the subscriber station under test and observing if there is an interruption in the corresponding return signal received at the monitoring station. Should there be an interruption, this indicates either equipment malfunction, or of course an attempt to compromise the system.

DESCRIPTION OF THE PREFERRED EMBODIMENTS

Figures 1, 1A:
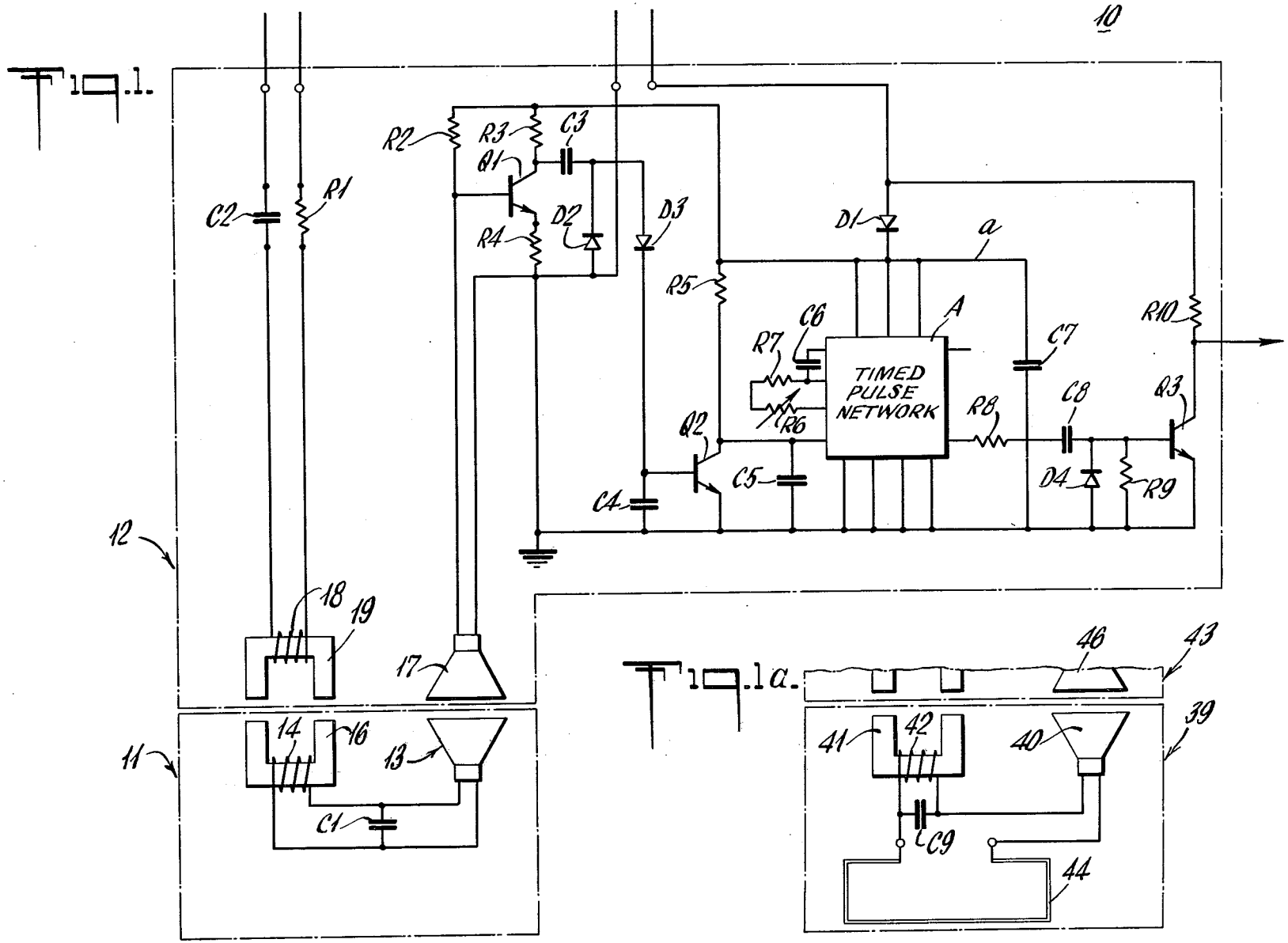
FIG. 1 is a schematic and diagrammatic view of a preferred embodiment of the present invention shown as applied to a door.
FIG. 1*a* is a fragmentary view similar to FIG. 1 showing a modified embodiment as applied to a window.
Figure 2:
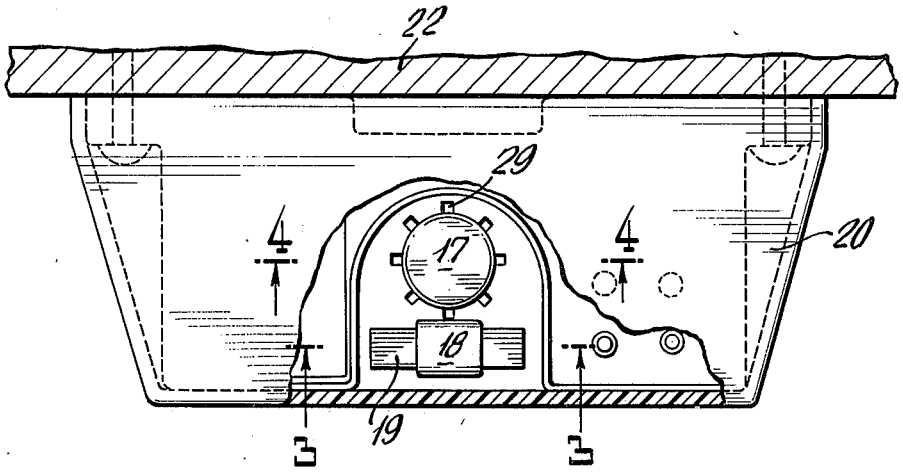
FIG. 2 is a plan view, partially fragmentary of a section of the sensing mechanism of the system shown in FIGS. 1 and 1*a;*
Figure 3:
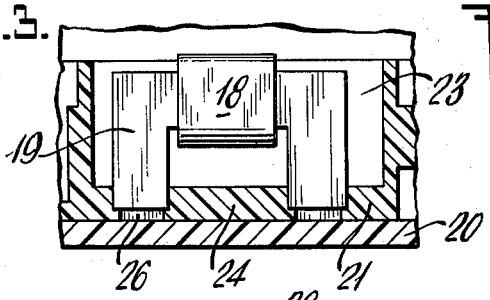
FIG. 3 is a sectional view taken along line 3—3 in FIG. 2.
Figure 4:
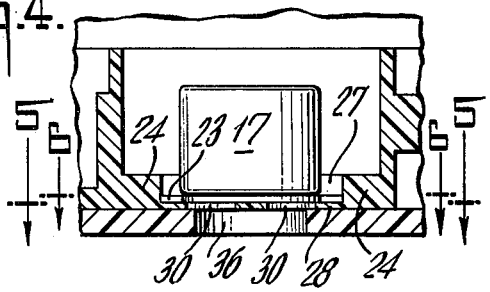
FIG. 4 is a sectional view taken along line 4—4 in FIG. 2.

Referring now to the drawings, particularly FIGS. 1 and 2 to 6 thereof which illustrate a preferred embodiment of the present invention as applied to the sensing of the opening and closing of a door or other closure member, the reference numeral 10 generally designates the improved system which comprises a detector having movable first section or contact 11 mounted in or on the door in any suitable manner and a stationary second section or contact 12 mounted on a stationary member such as the door jamb and being adjacent to and confronting the first section 11 when the door is in closed position and being remotely spaced from and not confronting the first section 11 when the door is moved or swung toward its open position.

As shown diagrammatically in FIG. 1, the first section 11 includes an electro-mechanical audio frequency first transducer 13 which may be of the electromagnetic or piezoelectric type or the like and is preferably ceramic and a jack-up or transformer coil 14 electrically connected to the input of first transducer 13, the leads connecting transducer 13 and coil 14 being shunted by a capacitor CI. The coil 14 is wound on a U-shaped magnetic coupling core 16 which is proximate to and facing in the same direction as first transducer 13.

The second section 12 includes a mechanical electrical audio frequency second transducer 17 and a second coil 18 wound on a U-shaped magnetic core 19 similar to core 16. The second transducer 17 may be similar to first transducer 13 and is stationary and so disposed that when the door is fully closed the audio output face of transducer 13 is adjacent to and directed towards the audio input face of second transducer 17 so that there is close or tight audio coupling between the output of transducer 13 and the input of transducer 17. Similarly, when the door is in closed position the end faces of the side legs of cores 16 and 19 are in close confrontation so that the cores 16 and 17 are tightly magnetically coupled as are the coils 14 and 18 by way of the cores. The coil 18 has one terminal connected through a capacitor C2 to one terminal of a pulsed AC source, preferrably of a supersonic frequency, for example, 40 KHz pulsed at 2 cycles per second with a pulse width of 1 millisecond, and its other terminal connected to the other terminal of the AC source through a resistor R1.

One terminal of the electrical output of second transducer 17 is grounded and the other terminal thereof is connected to the base of a transistor Q1, ground being connected to the negative terminal of a current source, the positive terminal of which is connected through a diode D1 to a positive line a, the current source being a positive repetitive pulse having the same pulse frequency as that energizing the coil 18, for example, two pulses per second.

The base of the transistor is connected through a resistor R2 to line a, the collector through a resistor R3 to a line a, a series connected capacitor C3 and diode D2 to ground and the emitter through a resistor R4 to ground.

The collector of transistor Q1 is also connected in series through the capacitor C3 and a diode D3 to the base of a transistor Q2 which is grounded through a capacitor C4. The collector of transistor Q2 is grounded through a capacitor C5, connected through a resistor R5 to line a and is connected to the triggering input terminal of a monostable multivibrator which defines a timed pulse network, the phase or time of whose output relative to the trigger signal input is controlled or adjusted by the variable resistor R6 which with resistor R7 and capacitor C6 form an RC timing network coupled into the network A which may be a 4047 16 mono unit with the 4, 8 and 14 terminals connected to line a, terminal 5, 7, 9 and 12 being grounded, terminal 6 being the triggering input terminal, the RC network series resistors R6 and R7 being connected between terminals 2 and 9 and capacitor C6 being connected between terminals 1 and 9 and terminal 11 being the output terminal. Line a is grounded through a high value filter capacitor C7 and the pulse output terminal of pulse network A is connected serially through a resistor R8 and a capacitor C8 to the base of an output transistor Q3 which base is grounded through a diode D4 whose anode is grounded and across which is connected a resistor R9. The emitter of transistor Q3 is grounded and the collector is connected through a resistor R10 to the positive terminal of the pulsed current source and constitutes the multiplex signal output which is transmitted to a remote monitoring station.

The first and second units 11 and 12 are of substantially similar construction and symmetrical to each other, and differing from each other primarily in that the stationary unit 12 houses the signal network and only the unit 12 will be described. Specifically, the unit 12, which in the case of a door is mounted on the door jamb and confronts the door mounted unit 11 when the door is in closed position, includes a casing 20 in which the ceramic transducer 17 and the magnetic core 19 carrying winding 18 are located in closely transversely spaced positions. The casing 20 is formed of a non-magnetic material, for example, an organic polymeric resin in which is nested a polymeric resin body member 21 attached to the door jamb 22 and having a well 23 medially formed in its outer top face and provided with a bottom wall 24. A pair of laterally spaced bores 25 are formed in the outer border of wall 24 and tightly engage the outer free ends of the upright core 19, the bores having restricted bottom openings 26.

Also formed in the top face of wall 24 inwardly of core 19 is a circular well 27 having a bottom wall 28 which has regularly peripherally spaced radially outwardly projecting rectangular recesses 29 formed therein. Sector shaped windows or openings 30 are formed in the wall 28 in radial alignment with respective recesses 29.

As an additional optional feature of the invention, means, such as a coding disc may be provided to deter unauthorized substitution of one of a set of contacts.

The coding disc 32 registers with the base of well 27 and has a radial tab 33 which releasably engages a preselected recess 29. A sector shaped window 34 is formed in the disc 32 and coincides with a window 30 when the tab 33 engages a recess 29. The transducer 17 is located in the well 27 with its input face directed downwardly and exposed to a sonic signal traversing the window 34. A circular opening 36 is formed on the bottom wall of casing 20 in coaxial vertical alignment with transducer 17 and windows 30 with a mating disc 32 having its window 34 in alignment with the mating window 34.

In the operation of the improved system 10 described above, when the door is in closed condition, the legs of the cores 16 and 19 are in magnetically coupled aligned condition and the transducers 13 and 17 are in coaxial sonically coupled condition by means of aligned windows 34. The pulsed supersonic electric current applied to the winding 18 is coupled by way of cores 16 and 19 to the capacitor tuned winding 14 whose output electrically energizes transducer 13 whose sonic output energizes transducer 17. The pulsed ultrasonic frequency electrical output of transducer 17 is amplified by transistor Q1 whose output is rectified and voltage doubled by the network including diodes D2 and D3 and capacitors C3 and C4 and applied to the base of transistor Q2. The signal output of transistor Q2 triggers the pulse network A whose signal output actuates transistor Q3 whose output is a timed multiplex signal which is transferred to the monitoring station when the network has timed out. Each set of windings issues its signal at a different time. Thus, when the door or other closure member is in closed condition, a signal is transmitted to the monitoring station. Upon opening of the door, coupling between transducers 13 and 17 is broken so that no signal is applied to the base of transistor Q1 and no output results at the output of transistor Q3. A warning or alarm is thus provided at the monitoring station in the absence of a signal at the designated time at the output of transistor Q3 which is caused by the door opening or any failure in the network or the electrical energizing source. It should be noted that the illustrated network including the transistors and pulse circuit is merely given by way of example and any other suitable or known network may be employed. Moreover, the network may produce a local alarm as well as signaling a remote station.

The timing network also allows for testing of the system. The central office stops the sending pulse to the system. If everything is operating properly, no return series of sequential signals should be received from the system. If a return signal or series of signals is received, either the equipment is malfunctioning or some unauthorized party is attempting to tamper with the system.

Because continuous pulses are being sent from the central office into the system, monitoring may be constantly maintained. A pulsed signal goes out to all locations (or sets of contacts) in the system. The amplified signal from the second transducer starts the timed pulse network A. Each network times out during a different time slot so that return signals are released sequentially and in a predetermined order. If two or more signals are received during the same time slot either as an echo effect or on top of each other (thus appearing as a single signal and leaving another time slot empty), the logic at the central office will throw the system into the alarm state. In the normal system provision is made for eight time slots, so if unauthorized personnel attempts to substitute on set of contacts with another set, there is a seven-eighths chance that an incorrect set will be used, and an alarm condition will be indicated.

Figure 5:
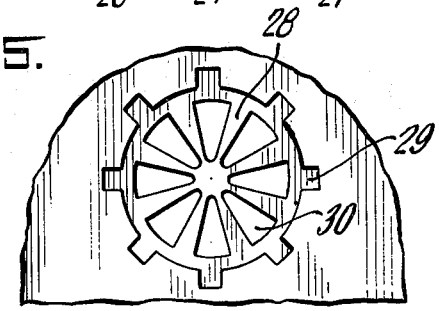
FIG. 5 is a sectional view taken along line 5—5 in FIG. 4 with a coding disc.
Figure 6:
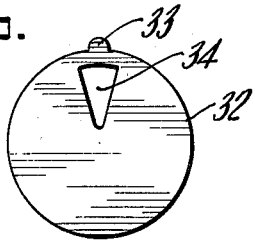
FIG. 6 is a partial sectional view taken along line 6—6 in FIG. 4 of the coding disc.

As an additional optional feature, the coded discs act as a deterrent against substitution of one of the two contacts. For example, if a door is opened an extra contact 11 mignt be placed against contact 12. As shown in FIGS. 5 and 6 the discs 32 are placed in wells 27 of a set of contacts so that windows 34 are in alignment with each other. If an unauthorized contact replaces one of the pair, since there are eight openings, there is a seven-eighths chance that non-alignment will occur, and the signal will not pass from transducer 13 to transducer 17.

In FIG. 1*a* of the drawings, there is illustrated a modification of the system described above which senses a breaking of the closure member as well as the opening of the closure member, the modified system differs from that first described only in that the closure member mounted transducer is connected to the associated energizing coil through a frangible conductor circuit mounted on the closure member and severed with the fracturing or breaking of the closure member.

Specifically, the closure member mounted first unit 39 includes a first transducer 40, a magnetic core 41 carrying a winding 42 corresponding to transducer 13, core 16 and winding 14 and cooperating with a stationary unit 43 corresponding with the unit 12. The winding 42 is directly shunted by a capacitor C9 and has one terminal connected to one terminal of the electrical input to transducer 40 and its other terminal connected to the other transducer terminal through a frangible conductor tape circuit 44 of any suitable configuration which is adhered to the border or other desired area of the closure member, a window pane or door panel or the like. Thus, the opening of the closure member carrying the unit 39 or the rupturing of the conductor tape 44 interrupts the excitation and signal output of the receiver transducer 46 and the signal to the monitoring station in the manner of the embodiment first described.

Figure 7:
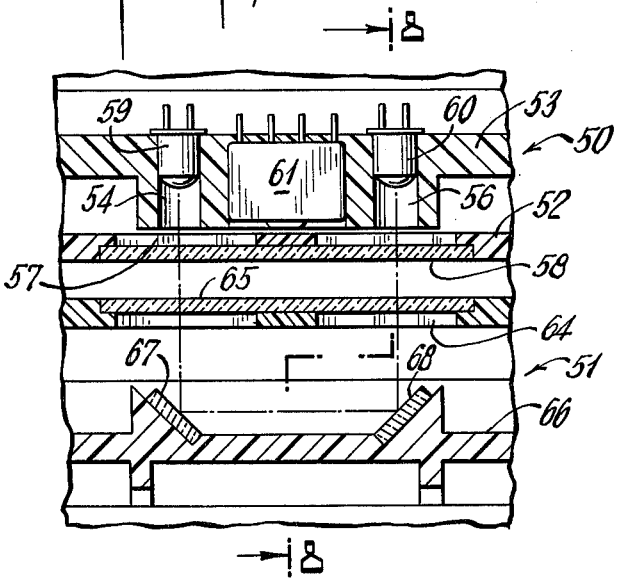
FIG. 7 is a longitudinal medial sectional view of the sensing section of another embodiment of the present invention.
Figure 8:
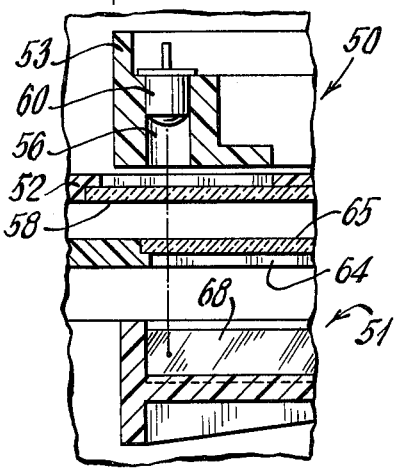
FIG. 8 is a sectional view taken along line 8—8 in FIG. 7.

Referring now to FIGS. 7 and 8 of the drawings which illustrate another embodiment of the present invention in which infrared light is employed as the closure member position sensing signal. The sensing system includes a stationary unit 50 and a closure member mounted unit 51, the units being in registering confrontation when the closure member is in closed condition.

The stationary unit 50 includes a suitably mounted housing 52 containing a mounting body 53 having a pair of transversely spaced vertical bores 54 and 56 respectively. An opening 57 is formed in the bottom wall of housing 52 in vertical registry with the bores 54 and 56 and is covered by an infrared transparent panel 58. An infrared emitting LED 59 telescopes the bore 54 and has a downwardly directed light emitting face an an infrared sensitive photoresponsive member 60, for example, a photoconductor or phototransistor telescopes the bore 56 and has a downwardly directed photoresponsive face. The associated circuitry which may be of the general nature of that employed in the first embodiment is housed in a casing nesting in a well in body member 53.

The closure member mounted unit 51 includes a housing 63 having an opening 64 in its top wall which registers with stationary unit opening 57 when the closure member is in closed position and is covered by an infrared transparent panel 65. Located in the housing 63 is a mount member which supports a pair of transversely spaced 45° inclined mirrors 67 and 68. The mirror 67 is oriented to reflect infrared radiation from LED 59 when the closure member is closed and the LED 59 is directly vertically above mirror 67, horizontally to mirror 68 which reflects such radiation to the photoresponsive member 60. The photoresponsive member 60, when exposed to the infrared radiation, controls a network in the manner earlier described, to transmit a signal to the remote monitoring station or to an alarm system. When the closure member is opened the reflection and direction of the radiation from LED 59 to photoresponsive member 60 is interrupted with a consequent interruption of the signal to the monitoring system.

While there have been described and illustrated preferred embodiments of the present invention it is apparent that numerous alterations, omissions and additions may be made without departing from the spirit thereof.

We claim:

1. In combination with a closure member movable between a closed and open position relative to a stationary member, a system for sensing the position of said closure member relative to said stationary member comprising a first transducer having an electrical input signal and an output signal of predetermined type and mounted on one of said members, a second transducer having an input signal of said predetermined type and an electrical output, said first and second transducers being tightly coupled by said predetermined type signal output of said first transducer when said closure member is in closed position producing an output signal from said second transducer and being relatively uncoupled when said closure member is in open position producing a signal change, and means responsive to the output signal of said second transducer, said predetermined signal type comprising sound, said first transducer comprising an electro-mechanical transducer and said second transducer comprising a mechanical-electrical transducer operable in the sound frequency range, a first coil on said stationary member, means adapted to connect said first coil to a source of alternating current, and a second coil on said closure member electrically connected to said first transducer and magnetically coupled to said first coil when said closure member is in said closed position.

2. The system of claim 1 wherein said first transducer is located on said closure member and said second transducer is located on said stationary member.

3. The system of claim 2 including means for applying a supersonic alternating current signal to said first transducer.

4. The system of claim 1 including a magnetic core disposed in each of said coils and being in magnetically coupled confrontation when said closure member is in closed position.

5. The system of claim 4 wherein said first and second transducers are located on said stationary member and comprising means located on said closure member coupling the output signal of said first transducer to the input of said second transducer when said closure member is in its closed position.

6. In combination with a closure member movable between a closed and open position relative to a stationary member, a system for sensing the position of said closure member relative to said stationary member comprising:

an infrared LED mounted on said stationary member, said LED having an electrical input signal and an output signal of infrared light;

an infrared-responsive photosensitive element mounted on said stationary member, said photosensitive element having an input signal of infrared light and an electrical output signal;

light deflecting means on said closure member directing infrared light emitted by said LED to said photosensitive element so as to tightly couple said LED and said photosensitive element by said infrared light when said closure member is in its closed position (thus producing an output signal from said photosensitive element), said LED and photosensitive element being relatively uncoupled when said closure member is in its open position (thus producing a change in the output signal of said photosensitive element); and means responsive to the output signal of said photosensitive element.

7. The system of claim 1 comprising means including a first capacitor connected to said first coil to form circuit therewith resonant at a predetermined frequency and means including a second capacitor connected to said second coil to form a circuit therewith resonant at said predetermined frequency.

8. The system of claim 1 wherein said closure member comprises an insulating panel and further comprising a frangible conductor adherent to said insulating panel and connected between said second coil and said first transducer.

9. The system of claim 1, the responsive means including an output signal unique to the second transducer.

10. The system of claim 9, the responsive means including a time delay network having a preselected time delay.

11. The system of claim 10, including means to sense the signal from the time delay network and to ascertain if the signal is correct for the said closure members.

12. The system of claim 11, including means to sense the output signal from said time delay network.

13. The system of claim 1, including means to sense the responsive means.

14. In combination with a closure member movable between a closed and open position relative to a stationary member, a system for sensing the position of said closure member relative to said stationary member comprising a plurality of detectors; each of said detectors comprising a first transducer having an electrical input signal and an output signal of predetermined type and mounted on one of said members, a second transducer having an input signal of said predetermined type and an electrical output, said first and second transducers being tightly coupled by said predetermined type signal output from said first transducer when said closure member is in closed position producing an output signal from said second transducer and being relatively uncoupled when said closure member is in open position producing a signal change, and a time delay network connected to receive the output signal of said second transducer; the time delay network in each of said detectors having a different time delay; signal source means connected to each of said detectors for simultaneously applying said electrical input signal to each of said first transducers, whereby the output signal from said time delay network in each of said detectors appears at a different predetermined time.

15. The system of claim 14, including further means to ascertain if the output signals in response to the signal source is correct for each of the detectors.

* * * * *